United States Patent [19]

Rohner

[11] Patent Number: 4,875,321

[45] Date of Patent: Oct. 24, 1989

[54] ROOFING SHINGLES

[76] Inventor: Nicholas J. Rohner, Delhi, N.Y. 13753

[21] Appl. No.: 239,941

[22] Filed: Sep. 2, 1988

[51] Int. Cl.[4] ..... E04D 1/28

[52] U.S. Cl. ..... 52/553; 52/518; 52/540

[58] Field of Search ..... 52/420, 553, 528, 540, 52/518, 541, 542, 543, 551, 552, 553, 555

[56] References Cited

U.S. PATENT DOCUMENTS

| | | | |
|---|---|---|---|
| 1,088,803 | 3/1914 | Bishopric | 52/553 |
| 1,335,756 | 4/1920 | Scarff | 52/553 |
| 1,447,290 | 3/1923 | Fischer . | |
| 1,795,913 | 3/1931 | Weaver | 52/420 |
| 2,047,161 | 7/1936 | Abraham | 52/553 |
| 2,135,811 | 11/1938 | Goslin . | |
| 2,148,167 | 2/1939 | Lyman | 52/540 |
| 2,161,440 | 6/1939 | Venrick | 52/553 |
| 2,666,402 | 1/1954 | Clawol . | |
| 2,863,405 | 12/1958 | Leibrook et al. . | |
| 3,082,577 | 3/1963 | Fasold et al. . | |
| 3,511,008 | 5/1970 | Grems et al. | 52/520 |
| 3,894,376 | 7/1975 | Shearer | 52/518 |
| 4,102,107 | 7/1978 | Barker et al. | 52/553 |
| 4,404,783 | 9/1983 | Freiborg | 52/518 |
| 4,466,226 | 8/1984 | Rohner | 52/748 |
| 4,587,785 | 5/1986 | Rohner | 52/420 |

FOREIGN PATENT DOCUMENTS

| | | | |
|---|---|---|---|
| 561283 | 8/1958 | Canada | 52/553 |
| 577829 | 6/1959 | Canada | 52/553 |

*Primary Examiner*—Michael Safavi

[57] ABSTRACT

Roofing shingles of the solid variety including a backing strip of rectangular-shaped light-weight material such as cardboard mounted on a flat sheet of weather-resistant material, the backing strip having substantially the same thickness as the flat sheet and being affixed to the upper portion of the back of the flat sheet, but below the upper edge of the flat sheet.

7 Claims, 1 Drawing Sheet

ROOFING SHINGLES

BACKGROUND OF THE INVENTION

1. Field of the Invention.

The present invention relates to roofing shingles and more particularly is directed to a roofing shingle of the solid type, coated with ceramic granuales and usually made from either felt or fiberglass and asphalt, but including a backing strip of light-weight material such as cardboard and having substantially the same thickness as the weather-resistant sheet located on the back of the sheet of weather-resistant material. The backing strip which would also be weather resistant, located in the upper portion of the shingle, but below the upper edge. The backing strip is rectangular in shape like the flat sheet.

2. Description of the Prior Art

In an earlier-filed application of the same inventor, Ser. No. 442,597, now U.S. Pat. No. 4,466,226, filed Nov. 18, 1982, a shingle is shown with a series of marks on the shingle for convenience in cutting the shingle. In that application, a series of methods are taught for installing a roofing shingle with overlapped joints rather than butt joints to assist in avoiding leaks.

In still another earlier-filed application of the same inventor, Ser. No. 624,099, now U.S. Pat. No. 4,587,785, filed June 25, 1984, a pair of coordinated roofing shingles of the solid type are shown with at least two vertical adhesive strips to hold down both of the coordinate shingles and to seal the overlap between two adjoining shingles in the same row of shingles so as to prevent the horizontal flow of water at the overlaps.

It has also been known in the art to provide a plastic film between shingles when bundled for shipment to prevent the singles from sticking together. Also, with the present invention, the backing strip, along with it's other distinctive useful features, serves to permit packaging without sticking problems. With the shingles stored or packed on top of one another with the backing strips always located downwardly, the upper major edge and the lower major edge of the flat sheet of each shingle will bend downwardly, providing a desirable preformed shape to each shingle for affixing to the roof.

With the known techniques for laying roof shingles, the upper two inches, the middle two inches, and the lower two inches of a series of twelve inch shingles in successively higher rows form three layers of shingle, while in the remaining areas of each shingle, there are only two shingle layers on a roof. As a result, a void forms beneath a shingle from the top edge of the next lower course of shingles to the top of the shingle itself. The backing strip fills that void up to the point where the triple layer is formed.

It is also recognized that modern shingles have a poor tensile strength making nailing difficult. The backing strip provides a stiffer shingle which grips the nails securely thereby holding the shingles securely in place without the nails being pulled through the shingles. Besides providing better holding power through the nails, the backing strip eliminates the void caused by the top edge shingle thickness as succeeding courses are applied. Previously, this condition limited nailing to the lowest two-inch or one-third area where the nail heads would be covered, but least covered, by the next course. Nailing above this lowest covered two-inch area, especially during cold weather, naturally results in holes larger than the nail shank area since the nail would be driven into only two layers of roofing with a void beneath it.

Shingles also currently slide readily on a roof and do not provide a stop to hold them and to guide them in place for nailing. The marks proposed by the first earlier patent referred to herein assists with the problem of guiding the placement of the shingles, but having a positive edge against which to butt the shingle against the next lower course, assures an even roof without visual checking, while at the same time providing a positive edge on which to rest shingles so that they cannot slide off the roof.

The novel features which are considered as characteristics of the invention are set forth with particularity in the appending claims. The invention itself, however, as to its construction and obvious advantages will be best understood from the following description of the specific embodiment when read with the accompanying drawings.

SUMMARY OF THE INVENTION

The present invention overcomes the disadvantages of the previous design of shingle by providing a roofing shingle in the form of a flat sheet of weather-resistant material with a backing strip having a thickness substantially equal to the thickness of the flat sheet, located on the back of the weather-resistant sheet below the upper edge and in the upper portion of the back of the weather-resistant sheet. The strip would preferably be made of a light-weight, weather-resistant material such as a coated cardboard.

DESCRIPTION OF THE DRAWINGS

The present invention may be better understood and its numerous advantages will be apparent to those skilled in the art by reference to the accompanying drawings, wherein like reference numerals refer to like elements in the various figures in which.

DETAILED DESCRIPTION OF THE INVENTION

As is set forth in U.S. Pat. No. 4,466,226, previously referred to herein, shingles are placed on a roof in a variety of ways, but essentially, a one-half size shingle 11 is located between two full-size shingles 13 in the same row. The full-size shingles 13 overlap at the ends of the half-size shingle 11, so that the half-size shingle 11 is exposed approximately for the length of one-third of the length of a full-size shingle 13. This invention contemplates the use of such a pair of coordinated shingles.

In the British system, full-size shingles 13 have a width of twelve inches and a length of thirty-six inches. A half size shingle 11 also has a width of twelve inches, but has a length of only eighteen inches. When installed, the half-size shingles 11 are overlapped at the ends by approximately three inches, leaving twelve inches of the length of the half-size shingle 11 exposed.

Figure 3:
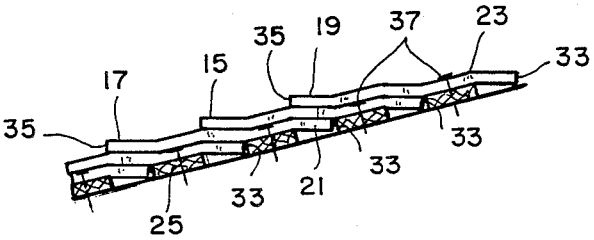
FIG. 3 is a cross-sectional view of a roof with the shingles in place overlapping one another.

Referring to FIG. 3, a second successive row of shingles 15 extends over the first successive row of shingles 17 directly beneath it by seven inches. Therefore, the upper two inches of the first successive row of shingles 17 is covered by a portion of a third successive row of shingles 19, as well as the second successive row of shingles 15, making a triple layer of shingles at one point 21.

A metric-size shingle is also available, and is just slightly larger than the shingle with British system measurements.

In accordance with this invention, each shingle, either half size 11 or full size 13, includes a flat sheet 23 of weather-resistant material with a backing strip 25, on the back side 27 of the flat sheet 23. The backing strip 25 would preferably be made from a light-weight material that is weather-resistant, such as a plastic-coated cardboard.

Each shingle, whether a full-size shingle 13, or a half-size shingle 11, has two major edges 29, and two minor edges 31, and has a rectangular shape. The major edges 29 are placed substantially horizontally and parallel with the horizontal edge of the roof. One major edge 29, which is located toward the top of the roof is the upper major edge 33, and the other major edge, which is located closest to the lower edge of the roof, is the lower major edge 35. The minor edges 31, which are shorter than the major edges 29, are placed vertically on the roof substantially parallel with the vertical or side edges of the roof.

Figure 1:
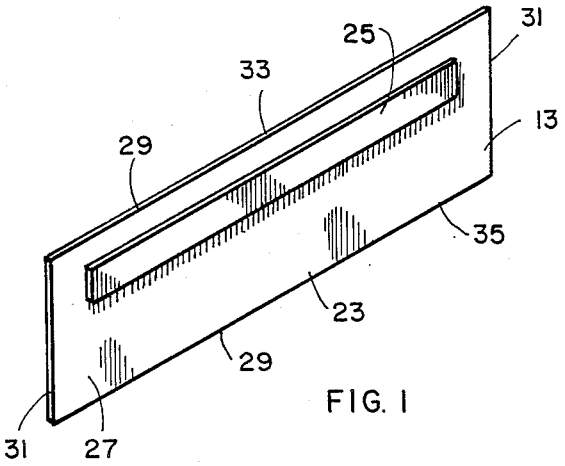
FIG. 1 is a perspective view of the back of the full-size shingle showing the weather-resistant sheet and the backing strip.
Figure 2:
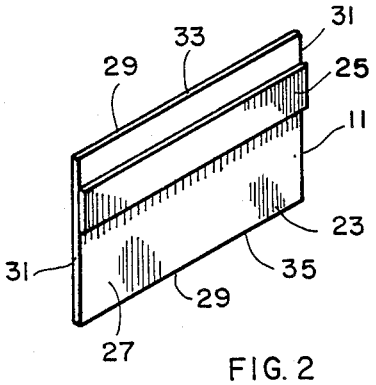
FIG. 2 is a perspective view of the back of the half-size shingle showing the weather-resistant sheet and the backing strip.

At best, as seen in FIG. 1, the backing strip 25, which is a part of the full-size shingle 13, is located below the upper major edge 33 of the full-size shingle 13 and on the rear side or back 27 of the shingle, either half size 11 or full size 13, which is the opposite side from the side exposed to the weather or, in other words, is the side of either shingle 11, 13 placed down on the surface of the roof.

With the full-size shingle 13, as used in the British system, the backing strip 25, which is also rectangular and has substantially the same thickness as the full-size shingle 13 itself, has a width of three inches, which is twenty-five percent (25%) of the width of the full-size shingle 13, and is located substantially parallel to the two major edges 29, but substantially two inches, which is sixteen and two-thirds percent (162/3%) of the width of the full-size shingle, below the upper major edge 33, leaving seven inches below the backing strip 25, and the lower major edge 35 of the full-size shingle 13. The seven inches below the lower edge of the backing strip 25 is fifty-eight and one-third percent (581/3%) of the width of the full-size shingle 13. With the full-size shingle 13, the backing strip 25 does not have the same length as the flat sheet 23, but even though it is substantially centered between the two minor edges 31, the backing strip 25 is shorter in length at each end than the full-size shingle 13 by three to three and a quarter inches, which is eight and one third percent (8⅓%) to nine percent (9%) of the length of the full-size shingle between the ends of the flat sheet 23 and the ends of the backing strip 25. The use of percentages makes possible a dimensional guide applicable to both the British size shingle and the Metric size shingle.

The half-size shingle 11 has a length substantially one-half the length of the full-size shingle 13. The half-size shingle 11 has two major edges 29, which are the horizontal edges and two minor edges 31, which are the smaller vertical edges. The terms "horizontal" and "vertical" refer, of course, to the orientation of the major edges 29 and the minor edges 31 when either shingle 11, 13 is placed on a roof.

The length of the minor edges 29 of the half-size single 11 is the same as the length of the minor edges 31 full-size shingle 13. However, with the half-size shingle 11 the backing strip 25 extends substantially the full length of the half-size shingle 11 between the two minor edges 31. The width, thickness and composition of the backing strip 25 and its placement between the two major edges 29 of the half-size shingle 11 is the same as that of the full-size shingle 13.

As has been previously pointed out, the full-size shingles 13 overlap, at their ends, the half-size shingles 11 by approximately three inches. It is for this reason that the backing strip 25, which is part of, and is located on the rear side 27 of the full-size shingle 13, is located three inches to three and a quarter inches inside the minor edges 31 of the full-size shingle 13.

Referring now to FIG. 3, it can be seen that on a roof, a section of three successive rows of shingles 15, 17, 19 is formed from the top two inches (using the British System) of the first successive row 17, which is the row lowest on the roof and with the middle two inches of the second successive row on top of the top two inches of the first successive row 17 at the triple layer point 21. The lowest two inches of the third successive row 19 provides the top layer at the triple layer point 21.

The backing strip 25 affixed to the second successive row 15 butts against the upper major edge 33 of the flat sheet 21 of the first successive row 17. Without the presence of the backing strip 25 on the second successive row 15, the void still remaining above the backing strip 25 would instead extend from the upper major edge 33 of the first successive row 17 to the upper major edge 33 of the second successive row 15.

In the past, to avoid an oversized nail hole caused by the void, it was essential to affix the second successive row 15 of shingles 11, 13 to the roof by placing a nail 37 through the middle two inches or center portion of the second successive row 15 of shingles 11, 13. Even using the uppermost part of that middle two inches of the second successive row 15 meant that less than two inches of the third successive row 19 covered the head of the nail 37. However, as seen in FIG. 3, in accordance with this invention, in view of the strip affixed to and being a part of the shingles in the second successive row, a nail 31 can be firmly driven with greater assurance of a sound connection to the roof while providing a greater distance of the nail 37 from the lower major edge 35 of the third successive row 19. As seen in FIG. 3, the nail 37 is preferably placed midway in the backing strip 25 adding an additional one and a half inches to the distance of the nail 37 from the elements.

Figure 4:
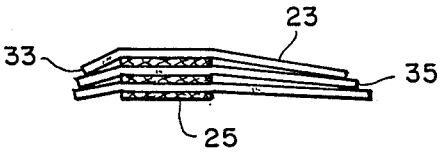
FIG. 4 is a side view of a stack of shingles as the shingles would be stored and shipped, showing the resulting bond to the shingles.

As best seen in FIG. 4, the shingles 11, 13 can be stored in a stack with the backing strip of each single aligned with the other backing strip in the stack. With the backing strips 25 below their respective flat sheet 23, the major edges 29 of the flat sheet 23 will bend downwardly causing a preformed desirable shape to the shingle 11, 13 when placed on the roof since the nail 37 will pull down the central portion of the shingle 11, 13, resulting in a flat roof without the undesirable upcurled lower major edge 35.

While a preferred embodiment has been shown and described, various modifications and substitutions may be made without departing from the spirit and scope of this invention. Accordingly, it is understood that this invention has been described by way of illustration rather than limitation.

I claim:

1. A pair of coordinated roofing shingles for use in covering a roof by placing a series of rows of overlapping shingles on the roof, said pair of coordinated roofing shingles comprising:

a full-size shingle including a flat sheet of weather-resistant material having a front side exposed to the weather and a rear side which is placed against the roof and having a rectangular shape with two minor edges and two major edges, the major edges of the full-size shingle being approximately three times the length of the minor edges, said full-size shingle further including a backing strip of weather-resistant material substantially of rectangular shape and having a thickness substantially equal to the thickness of the flat sheet of weather-resistant material and being affixed to the rear side of the full-size shingle and being located substantially parallel to the two major edges, and substantially equally-spaced between the two minor edges with a length less than the length of the two major edges; and a half-size shingle including a flat sheet of weather-resistant material having a front side exposed to the weather and a rear side which is placed against the roof, and having a rectangular shape with two minor edges and two major edges, the major edges of the half-size shingle being approximately one and one-half times the length of the minor edges of the full-size shingle, the minor edges of both the half-size shingle and the full-size shingle being substantially the same, said half-size shingle further including a backing strip substantially of rectangular shape and having a thickness substantially equal to the thickness of the flat sheet of weather-resistant material and being affixed to the rear side of the flat sheet of weather-resistant material and being located parallel to the two major edges and extending substantially the entire length of the major edges between the two minor edges.

2. A pair of coordinated shingles according to claim 1, wherein the backing strip affixed to the full-size shingle has a length approximately ninety-one and two-thirds percent (912/3%) the length of the two major edges of the full-size shingles.

3. A pair of coordinated shingles according to claim 1, wherein the backing strip affixed to the full-size shingle has a width approximately twenty-five percent (25%) of the length of the two minor edges of the full-size shingle.

4. A pair of coordinated shingles according to claim 1, wherein the backing strip affixed to the full-size shingle is located approximately sixteen and two-thirds percent (162/3%) of the length of the minor edges from one major edge and fifty-eight and one-third (581/3%) the length of the minor edges from the other major edge.

5. A pair of coordinated roofing shingles according to claim 1, wherein the backing strip affixed to the half-size shingle has a width approximately twenty-five percent (25%) of the length of the two minor edges.

6. A pair of coordinated roofing shingles according to claim 1, wherein the backing strip affixed to the half-size shingle is located approximately sixteen and two-thirds percent (162/3%) the length of the minor edges from one major edge and fifty-eight and one-third percent (581/3%) the length of the minor edges from the other major edge.

7. A pair of coordinated roofing shingles for use in covering a roof by placing a series of rows of overlapping shingles on the roof, said pair of coordinated shingles comprising:

a full-size shingle including a flat sheet of weather-resistant material having a front side exposed to the weather and a rear side which is placed against the roof and having a retangular shape with two minor edges and two major edges, the major edges of the full-size shingle being approximately three times the length of the minor edges, said full-size shingle further including a strip of cardboard substantially of rectangular shape and having a thickness substantially equal to the thickness of the flat sheet of weather-resistant material and being affixed to the rear side of the full-size shingle and being located substantially parallel to the two major edges, and substantially equally-spaced between the two minor edges with a length approximately ninety-one and two thirds percent (912/3%) the length of the two major edges, said cardboard strip having a width approximately twenty-five percent (25%) of the length of the two minor edges and being located approximately sixteen and two-third percent (162/3%) the length of the minor edges from one major edge and fifty-eight and one-third percent (581/3%) the length of the minor edges from the outer major edge; and a half-size shingle including a flat sheet of weather-resistant material having a front side exposed to the weather and a rear side which is placed against the roof and having a rectangular shape with two minor edges and two major edges, the major edges of the half-size shingle being approximately one and one-half times the length of the minor edges of the half-size shingle, the minor edges of both the half-size shingle and the full-size shingle being substantially the same, said half-size shingle further including a strip of cardboard substantially of rectangular shape and having a thickness substantially equal to the thickness or the flat sheet of weather-resistant material and being affixed to the rear side of the flat sheet of weather-resistant material and being located parallel to the two major edges and extending substantially the entire length of the major edges between the two minor edges, said cardboard strip having a width approximately twenty-five percent (25%) of the length of the two minor edges and being located approximately sixteen and two-thirds percent (162/3%) the length of the minor edges from one major edge and fifty-eight and one-third percent (581/3%) the length of the minor edges from the other major edge.

* * * * *